US009771643B2

(12) United States Patent
Ninomiya et al.

(10) Patent No.: US 9,771,643 B2
(45) Date of Patent: Sep. 26, 2017

(54) CARBURIZED PART, METHOD FOR MANUFACTURING THEREOF, AND STEEL FOR CARBURIZED PART

(71) Applicants: Akihito Ninomiya, Saitama (JP); Yoshinari Okada, Saitama (JP); Takahiro Miyazaki, Aichi (JP); Yasushi Matsumura, Aichi (JP); Shinichiro Kato, Aichi (JP); Tetsuya Shimomura, Aichi (JP)

(72) Inventors: Akihito Ninomiya, Saitama (JP); Yoshinari Okada, Saitama (JP); Takahiro Miyazaki, Aichi (JP); Yasushi Matsumura, Aichi (JP); Shinichiro Kato, Aichi (JP); Tetsuya Shimomura, Aichi (JP); Katsuya Yamaguchi, Aichi (JP)

(73) Assignees: HONDA MOTOR CO., LTD., Tokyo (JP); DAIDO STEEL CO., LTD., Aichi (JP)

( * ) Notice: Subject to any disclaimer, the term of this patent is extended or adjusted under 35 U.S.C. 154(b) by 295 days.

(21) Appl. No.: 14/245,229

(22) Filed: Apr. 4, 2014

(65) Prior Publication Data

US 2014/0299234 A1 Oct. 9, 2014

(30) Foreign Application Priority Data

Apr. 8, 2013 (JP) ..... 2013-080732

(51) Int. Cl.

| | |
|---|---|
| ***C23C 8/22*** | (2006.01) |
| ***C23C 8/02*** | (2006.01) |
| ***C23C 8/80*** | (2006.01) |

(52) U.S. Cl.

CPC ..... *C23C 8/22* (2013.01); *C23C 8/02* (2013.01); *C23C 8/80* (2013.01)

(58) Field of Classification Search

CPC .. C23C 8/02; C23C 8/004; C23C 8/06; C23C 8/20; C23C 8/22; C23C 8/44; C23C 8/80;

(Continued)

(56) References Cited

U.S. PATENT DOCUMENTS 5,595,613 A * 1/1997 Hatano ..... C23C 8/22 148/206

8,475,605 B2 7/2013 Kubota et al.

(Continued)

FOREIGN PATENT DOCUMENTS

JP 51-90918 8/1976
JP 64-31927 A 2/1989

(Continued)

OTHER PUBLICATIONS

English language translation for JP 2007-231305A; Generated on Feb. 18, 2016 with AIPN Japan Patent Office site at https://dossier1.j-platpat.inpit.go.jp/tri/all/odse/ODSE_GM101_Top.action.*

(Continued)

*Primary Examiner* — Mark Ruthkosky
*Assistant Examiner* — Julia L Rummel
(74) *Attorney, Agent, or Firm* — Greenblum & Bernstein, P.L.C.

(57) ABSTRACT

The invention provides a carburized part which has excellent medium-cycle fatigue strength in particular subjected to surface-hardening treatment by carburization. The invention provides a carburized part including a carburized layer formed by performing carburizing treatment to a steel, the steel including, in terms of % by mass: 0.15% to 0.25% of C, 0.15% or less of Si, 0.4% to 1.1% of Mn, 0.8% to 1.4% of Cr, 0.25% to 0.55% of Mo, 0.015% or less of P, and 0.035% or less of S, with the remainder being Fe and unavoidable impurities, and the steel satisfying the following relation; 0.10≤[Mo]/(10[Si]+[Mn]+[Cr])≤0.40, in which (Continued)

[M] represents a content of element M in terms of % by mass.

4 Claims, 3 Drawing Sheets

(58) Field of Classification Search
CPC .. C23C 8/64; C22C 38/00; C21D 1/02; C21D 1/06; C21D 1/18; C21D 1/25; C21D 1/74; C21D 1/78
See application file for complete search history.

(56) References Cited

U.S. PATENT DOCUMENTS

| | | | | |
|---|---|---|---|---|
| 9,469,883 | B2 | 10/2016 | Kozawa et al. | |
| 2012/0018050 | A1 | 1/2012 | Kubota et al. | |
| 2012/0060979 | A1 | 3/2012 | Kozawa et al. | |
| 2012/0085465 | A1* | 4/2012 | Neishi | C21D 1/06 148/211 |
| 2013/0146181 | A1* | 6/2013 | Kubota | C21D 1/06 148/219 |
| 2013/0340895 | A1 | 12/2013 | Kozawa et al. | |

FOREIGN PATENT DOCUMENTS

| | | | | | |
|---|---|---|---|---|---|
| JP | 2-240249 | A | | 9/1990 | |
| JP | 06-306572 | | | 11/1994 | |
| JP | 2005-127403 | A | | 5/2005 | |
| JP | 2007231305 | A | * | 9/2007 | |
| JP | 2008-248284 | | | 10/2008 | |
| JP | 2010-150592 | | | 7/2010 | |
| JP | 2010-285689 | | | 12/2010 | |
| JP | 2011-137214 | | | 7/2011 | |
| JP | WO 2012108461 | A1 | * | 8/2012 | C12D 1/06 |
| WO | 2011/114836 | A1 | | 9/2011 | |

OTHER PUBLICATIONS

Roberts, G. Kennedy, R.; Krauss, G; "Tool Steels" 5th Ed., ASM International, 1998, p. 86.*
Capudean, B. "Metallurgy Matters: Carbon content, Steel Classifications, and Alloy Steels", Practical Welding Today, 2003, p. 1-7.*
Schneider, M.; "Introduction to Surface Hardnening of Steels" ASM Handbook, vol. 4A, 2013, p. 389-398.*
Office Action issued in Japan Counterpart Patent App. No. 2013-080732, dated Sep. 26, 2016 , along with an English translation thereof.

* cited by examiner

CARBURIZED PART, METHOD FOR MANUFACTURING THEREOF, AND STEEL FOR CARBURIZED PART

FIELD OF THE INVENTION

The present invention relates to a carburized part subjected to surface-hardening treatment by carburization, a method for manufacturing the carburized part, and a steel for carburized part. More specifically, the invention relates to a carburized part having excellent medium-cycle fatigue strength, a method for manufacturing the same, and a steel for carburized part.

BACKGROUND OF THE INVENTION

Carburized Parts subjected to surface-hardening treatment by carburization have been used as gear wheels, bearings and like parts in automotive transmissions or differential devices. On such carburized parts, various studies of fatigue strength have been carried out from both the viewpoint of a fatigue failure caused by a load imposed repeatedly at about $10^5$ or more times (high cycle fatigue) and the viewpoint of a fatigue failure caused by a load imposed repeatedly at about $10^3$ or less times (low cycle fatigue).

For example, Patent Document 1 has disclosed that adjustments to compositional proportions of Si, Mn and Cr in a steel for carburized part can improve high cycle fatigue strength of the carburized part subjected to surface-hardening treatment by carburization. In the case where a steel for carburized part, such as SCM21, is subjected to a carburizing treatment, and subsequently a heat treatment, a poorly hardened portion (a carburization anomaly layer) develops in the vicinity of the carburized steel surface, and causes degradation in high cycle fatigue strength in particular. With such a carburization anomaly layer formed by internal oxidation of Si, Mn and Cr, Patent Document 1 has concluded that adjustments to the compositional proportions of those elements in the steel allow improvement in the high cycle fatigue strength. More specifically, Patent Document 1 has disclosed that, in the steel which has, in terms of % by mass, a C content of 0.05% to 0.50%, an Si content of 0.05% or lower, an Mn content of 5% or lower and a Cr content of 5% or lower and can further contain other elements, such as Ni, Mo, Ti, V, Nb, Al and B, in proportions lower than individually specified values, contents of the elements Si, Mn and Cr having an effect on internal oxidation are required to satisfy the following relation;

$$10[Si]+0.1([Mn]+[Cr])\leq 1.00$$

wherein [M] represents a content of element M in terms of % by mass.

On the other hand, Patent Document 2, for example, has disclosed that the low cycle fatigue strength of a carburized part subjected to surface-hardening treatment by carburization can be improved by adjusting the composition of a steel for carburized part to be relatively high in Cr and Mn contents. Further, Patent Document 2 stated that not only toughness can be enhanced by limiting the C content to a lower value yet ensuring hardness in the vicinity of the carburized surface but also the low cycle fatigue strength can be improved by controlling the hardness difference between the vicinity of the carburized surface and the core portion so as to fall within a specified range. More specifically, Patent Document 2 has disclosed that, in the steel which has, in teems of % by mass, a C content of 0.05% to 0.20%, an Si content of 0.7% or lower, an Mn content of 1.41% to 2.0% and a Cr content of 1.0% to 2.0% and can further contain other elements, such as Ni, Mo, Ti, Nb, Al and B, in proportions lower than individually specified values, the C content in the carburized layer at the carburized surface is adjusted to fall within the range of 0.4% to 0.75% by mass and the hardness difference between the vicinity of the carburized surface and the core portion is controlled to the 200- to 400-Hv range.

By the way, studies on fatigue failure caused by a load imposed repeatedly at about $10^3$ to about $10^5$ times, or equivalently, medium cycle fatigue failure, has also come to be made in recent years. In general the medium cycle fatigue strength can be enhanced by carrying out improvements in both the low cycle fatigue strength and the high cycle fatigue strength.

Patent Document 3, for example, has stated that the medium cycle fatigue strength can be enhanced by adjusting the depth of a carburization anomaly layer formed after a carburization-based surface hardening treatment to 15 μm or less and reducing variations in the depth while controlling the contents of Si, Mo and B in a steel for carburized part. Therein, the low cycle fatigue strength is improved by enhancing the strength of grain boundaries in the carburized layer, and at the same time, occurrence of fatigue cracking is reduced by controlling the depth of a carburization anomaly layer and variations therein, which conduces to an enhancement of the high cycle fatigue strength. Thus Patent Document 3 has concluded that the medium cycle fatigue strength can also be improved.

In addition, Patent Document 4, for example, has disclosed that the depth of a carburization anomaly layer formed after a carburization-based surface hardening treatment can be adjusted to have a specified value or lower by controlling the contents of Si, Mn and Cr in a steel for carburized part. More specifically, Patent Document 4 has disclosed that, in the steel which has, in terms of % by mass, a C content of 0.15% to 0.25%, an Si content of 0.1% or lower, an Mn content of 0.2% to 0.8% and a Cr content of 0.2% to 0.8% and can further contain other elements, such as Ni, Mo, Ti, Nb, Al and B, in proportions lower than individually specified values, the depth of a carburization anomaly layer can be reduced to 6 μm or less by adjusting the C content in the carburized layer to fall within a range of 0.7% to 0.9%, the grain size in the carburized layer to be #9 or above and the contents of elements Si, Mn and Cr to satisfy the following relation;

$$10[Si]+[Mn]+[Cr]\leq 2.0$$

wherein [M] represents a content of element M of the carburized layer in terms of % by mass.

[Patent Document 1] JP-A-S51-90918
[Patent Document 2] JP-A-2008-248284
[Patent Document 3] JP-A-2010-150592
[Patent Document 4] JP-A-H6-306572

SUMMARY OF THE INVENTION

As mentioned above, in order to improve the medium cycle fatigue strength, both the low cycle fatigue strength and the high cycle fatigue strength should be enhanced, and enhancements of these two fatigue strengths necessitate controlling a distribution of hardness in an effective hardened layer given by carburization.

The invention has been made in view of these circumstances, and objects of the invention are to provide a carburized part which has excellent medium-cycle fatigue strength in particular subjected to surface-hardening treatment by carburization, a method for manufacturing thereof and a steel for such a carburized part.

The invention provides a carburized part comprising a carburized layer formed by performing carburizing treatment to a steel, the steel comprising, in terms of % by mass: 0.15% to 0.25% of C, 0.15% or less of Si, 0.4% to 1.1% of Mn, 0.8% to 1.4% of Cr, 0.25% to 0.55% of Mo, 0.015% or less of P, and 0.035% or less of S, with the remainder being Fe and unavoidable impurities, and the steel satisfying the following relation; $0.10 \leq [Mo]/(10[Si]+[Mn]+[Cr]) \leq 0.40$, wherein [M] represents a content of element M in terms of % by mass, wherein, in the carburized part, a maximum C content of the carburized layer in terms of % by mass is within a range of 0.45% to 0.75%, and a hardness $Hv_{d=25\ \mu m}$ at a depth of 25 μm below a surface of the carburized layer is 650 Hv or higher, a hardness $Hv_{d=50\ \mu m}$ at a depth of 50 μm below the surface of the carburized layer is 750 Hv or lower and a difference between the hardness $Hv_{d=25\ \mu m}$ and the hardness $Hv_{d=50\ \mu m}$ is 50 Hv or smaller.

According to the invention, not only low-cycle to medium-cycle fatigue strengths are enhanced by increasing toughness of a carburized layer through the control of the maximum C content in particular in the carburized layer whose hardness is heightened by performing a carburization-based surface hardening treatment to a steel having a specified composition, but also medium-cycle to high-cycle fatigue strengths are enhanced by achieving the specified distribution of hardness in the vicinity of the surface of the carburized layer. Thus the present carburized part can attain excellent medium-cycle fatigue strength.

Moreover, in the invention, it is preferred that the carburized part comprises, due to the carburization treatment, a region having a hardness of 700 Hv or higher, which is provided at a depth within 350 μm or less below the surface of the carburized layer. According to the invention characterized as above, the carburized part can attain especially excellent medium-cycle fatigue strength.

Further, the invention provides a method for manufacturing a carburized part, at least comprising: a pre-machining step of performing a predetermined machining to a steel the steel comprising, in terms of % by mass: 0.15% to 0.25% of C, 0.15% or less of Si, 0.4% to 1.1% of Mn, 0.8% to 1.4% of Cr, 0.25% to 0.55% of Mo, 0.015% or less of P, and 0.035% or less of S, with the remainder being Fe and unavoidable impurities, and the steel satisfying the following relation; $0.10 \leq [Mo]/(10[Si]+[Mn]+[Cr]) \leq 0.40$, wherein [M] represents a content of element M in terms of % by mass; and a carburizing treatment step wherein the machined steel is heated at a predetermined temperature and subjected to carburizing and diffusing treatment in a carburizing atmosphere having a predetermined carbon potential, and then hardened in a low-temperature oil bath kept at a temperature 80° C. or lower at the highest, thereby providing a carburized layer, wherein, in the carburizing treatment step, a maximum C content of the carburized layer in terms of % by mass is controlled to be within a range of 0.45% to 0.75%, and a hardness $Hv_{d=25\ \mu m}$ at a depth of 25 μm below a surface of the carburized layer is controlled to be 650 Hv or higher, a hardness $Hv_{d=50\ \mu m}$ at a depth of 50 μm below the surface of the carburized layer is controlled to be 750 Hv or lower and a difference between the hardness $Hv_{d=25\ \mu m}$ and the hardness $Hv_{d=50\ \mu m}$ is controlled to be 50 Hv or smaller.

According to the invention characterized as above, control of the maximum C content in particular in the carburized layer allows an improvement in the toughness of the carburized layer, thereby enhancing low-cycle to medium-cycle fatigue strengths, and concurrently the specified distribution of hardness in the vicinity of the carburized layer surface is achieved, thereby enhancing medium-cycle to high-cycle fatigue strengths. Thus the invention can provide a carburized part having excellent medium-cycle fatigue strength.

In the invention, it is preferred that the carburizing treatment step provides a region having a hardness of 700 Hv or higher at a depth within 350 μm or less below the surface of the carburized layer. According to the invention characterized as above, it becomes possible to provide a carburized part with excellent medium-cycle fatigue strength.

Furthermore, the invention provides a steel for carburized part, which is to be used for a carburized part obtained through surface-hardening treatment by carburization, the steel comprising, in terms of % by mass: 0.15% to 0.25% of C, 0.15% or less of Si, 0.4% to 1.1% of Mn, 0.8% to 1.4% of Cr, 0.25% to 0.55% of Mo, 0.015% or less of P, and 0.035% or less of S, with the remainder being Fe and unavoidable impurities, and the steel satisfying the following relation; $0.10 \leq [Mo]/(10[Si]+[Mn]+[Cr]) \leq 0.40$, wherein [M] represents a content of element M in terms of % by mass.

According to the invention characterized as above, the specified carburizing treatment is given, whereby a carburized part with excellent medium-cycle fatigue strength can be obtained.

DETAILED DESCRIPTION OF THE INVENTION

As to the carburized part having a carburized layer formed through the performance of carburizing treatment, an increase in hardness of the carburized layer generally allows relative enhancement of high cycle fatigue strength, but on the contrary it brings about a reduction in low cycle fatigue strength. The inventors have considered heightening strengths to resist both high cycle fatigue and low cycle fatigue through reduction in hardness of the carburized layer in its entirety while increasing hardness of the outermost surface of the carburized layer and thereby allowing the making of a carburized part having excellent medium-cycle fatigue strength.

Figure 1:
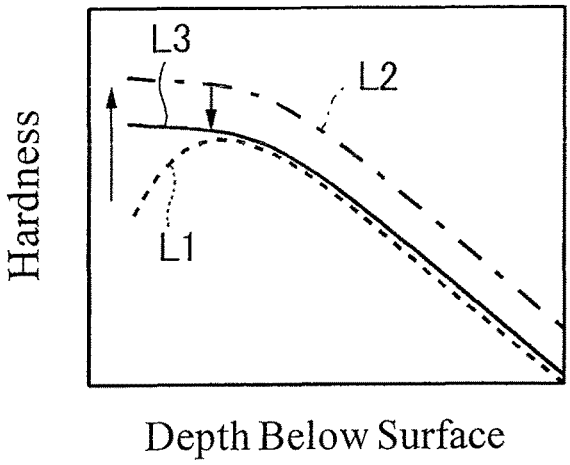
FIG. 1 is a graph showing distribution of hardness in cross-sections of a carburized part.

More specifically, as shown in FIG. 1, in the distribution of hardness L1 resulting from carburization, a hardness reduction is noticed at the outermost surface of a carburized layer capable of containing a carburization anomaly layer. However, the reduction in hardness of the outermost surface of the carburized layer can be prevented (distribution of hardness L2) by controlling occurrence of a carburization anomaly layer through adjustment to compositional proportions of Mo and Ni in the steel, and further by compensating for degradation in hardening property due to occurrence of a carburization anomaly layer with an intensity increase in the hardening after carburizing treatment. On the other hand, the carbon content in the carburized layer is adjusted to fall within the specified range through the control of carburizing treatment, thereby reducing the hardness of the carburized layer in its entirety (distribution of hardness L3).

In order to discover component compositions and carburizing treatment conditions of steels for use in making the carburized parts as mentioned above, descriptions are given below about results obtained by carrying out various tests on specimens modeled after the carburized parts according to Examples 1 to 10, Comparative Examples 1 to 17 and Reference Example 1, respectively, which are shown in Table 1 which is a table showing component compositions and carburizing treatment conditions of Examples, Comparative Examples.

TABLE 1

| | Constituent element (ladle analysis value, in terms of % by mass) | | | | | | | | | | Carburizing |
|---|---|---|---|---|---|---|---|---|---|---|---|
| | C | Si | Mn | P | S | Cu | Ni | Cr | Mo | Nb | condition |
| Example 1 | 0.20 | 0.10 | 0.84 | 0.009 | 0.012 | 0.10 | 0.10 | 1.15 | 0.30 | — | (a) |
| Example 2 | 0.20 | 0.04 | 0.71 | 0.009 | 0.012 | 0.10 | 0.11 | 1.00 | 0.31 | — | (a) |
| Example 3 | 0.20 | 0.04 | 0.71 | 0.008 | 0.012 | 0.10 | 0.10 | 1.00 | 0.41 | — | (a) |
| Example 4 | 0.20 | 0.03 | 0.71 | 0.009 | 0.012 | 0.10 | 0.10 | 0.99 | 0.52 | — | (a) |
| Example 5 | 0.18 | 0.04 | 0.71 | 0.009 | 0.012 | 0.08 | 0.05 | 1.00 | 0.31 | — | (a) |
| Example 6 | 0.22 | 0.04 | 0.71 | 0.009 | 0.012 | 0.10 | 0.11 | 1.00 | 0.31 | — | (a) |
| Example 7 | 0.20 | 0.04 | 0.55 | 0.005 | 0.005 | 0.20 | 0.15 | 0.99 | 0.40 | — | (b) |
| Example 8 | 0.20 | 0.05 | 0.55 | 0.005 | 0.006 | 0.21 | 0.15 | 1.39 | 0.49 | — | (b) |
| Example 9 | 0.20 | 0.05 | 0.65 | 0.007 | 0.006 | 0.20 | 0.17 | 0.81 | 0.40 | — | (b) |
| Example 10 | 0.20 | 0.06 | 0.40 | 0.005 | 0.006 | 0.19 | 0.15 | 1.00 | 0.50 | — | (b) |
| Comparative Example 1 | 0.20 | 0.06 | 0.65 | 0.006 | 0.006 | 0.21 | 0.15 | 0.99 | 0.29 | — | (a) |
| Comparative Example 2 | 0.20 | 0.04 | 0.55 | 0.005 | 0.005 | 0.20 | 0.15 | 0.99 | 0.40 | — | (a) |
| Comparative Example 3 | 0.20 | 0.05 | 0.65 | 0.007 | 0.006 | 0.20 | 0.15 | 1.41 | 0.40 | — | (a) |
| Comparative Example 4 | 0.20 | 0.05 | 0.65 | 0.007 | 0.006 | 0.20 | 0.17 | 0.81 | 0.40 | — | (a) |
| Comparative Example 5 | 0.20 | 0.06 | 0.40 | 0.005 | 0.006 | 0.19 | 0.15 | 1.00 | 0.50 | — | (a) |
| Comparative Example 6 | 0.20 | 0.08 | 0.65 | 0.006 | 0.006 | 0.20 | 0.15 | 1.40 | 0.25 | — | (a) |
| Comparative Example 7 | 0.20 | 0.05 | 0.55 | 0.005 | 0.006 | 0.21 | 0.15 | 1.41 | 0.49 | — | (a) |
| Comparative Example 8 | 0.20 | 0.05 | 0.65 | 0.008 | 0.006 | 0.20 | 0.15 | 1.01 | 0.21 | — | (a) |
| Comparative Example 9 | 0.20 | 0.05 | 0.65 | 0.007 | 0.006 | 0.21 | 0.15 | 0.85 | 0.19 | — | (a) |
| Comparative Example 10 | 0.20 | 0.05 | 0.39 | 0.007 | 0.006 | 0.20 | 0.15 | 1.00 | 0.31 | — | (a) |
| Comparative Example 11 | 0.21 | 0.15 | 0.85 | 0.007 | 0.012 | 0.10 | 0.10 | 1.15 | 0.11 | — | (a) |
| Comparative Example 12 | 0.20 | 0.20 | 0.85 | 0.009 | 0.013 | 0.10 | 0.10 | 1.18 | 0.40 | — | (a) |
| Comparative Example 13 | 0.20 | 0.21 | 0.85 | 0.008 | 0.012 | 0.10 | 0.10 | 1.15 | 0.25 | — | (a) |
| Comparative Example 14 | 0.20 | 0.11 | 0.84 | 0.008 | 0.012 | 0.11 | 0.10 | 1.15 | 0.14 | — | (a) |
| Comparative Example 15 | 0.20 | 0.10 | 0.84 | 0.008 | 0.013 | 0.10 | 0.10 | 1.15 | 0.22 | — | (a) |
| Comparative Example 16 | 0.20 | 0.06 | 0.40 | 0.008 | 0.013 | 0.10 | 0.48 | 0.65 | 0.77 | 0.020 | (a) |
| Comparative Example 17 | 0.20 | 0.06 | 0.65 | 0.006 | 0.006 | 0.20 | 0.15 | 0.99 | 0.29 | — | (c) |
| Reference Example 1 | 0.20 | 0.06 | 0.40 | 0.008 | 0.013 | 0.10 | 0.48 | 0.65 | 0.77 | 0.020 | (c) |

In the first place, methods of preparing specimens are described below using Table 1, FIG. 2 and FIGS. 3 (A) to 3 (C).

Figure 2:
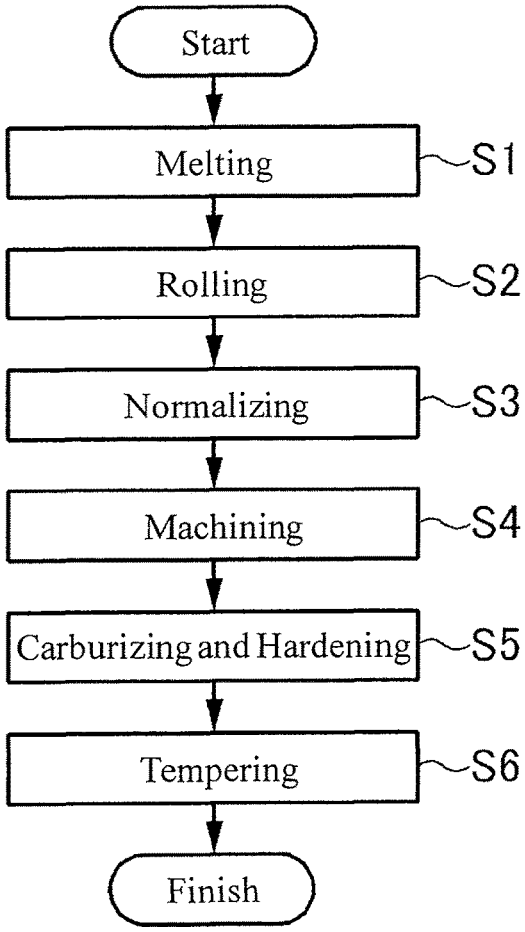
FIG. 2 is a flow chart for a manufacturing process of a carburized part according to the invention.

As shown in FIG. 2, an alloy having a given composition (see Table 1) is melted (S1), rolled (S2), normalized (S3), and then shaped into a 4-point bending fatigue specimen and a hardness specimen by machining (S4). Each specimen is subjected to carburizing treatment in propane gas used as a carbon source and carburization hardening (S5), then kept at 160° C. for 120 minutes, and further subjected to heat treatment for tempering through air cooling (S6). Thus, final specimens are obtained.

Figure 3:
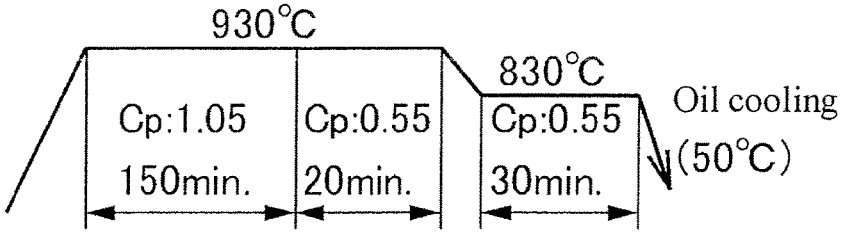
FIGS. 3 (A) to 3 (C) show diagrams of heat treatments under different carburizing-and-hardening conditions.
Figure 3:
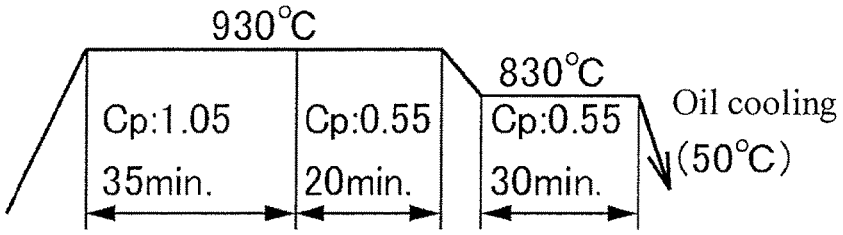
Figure 3:
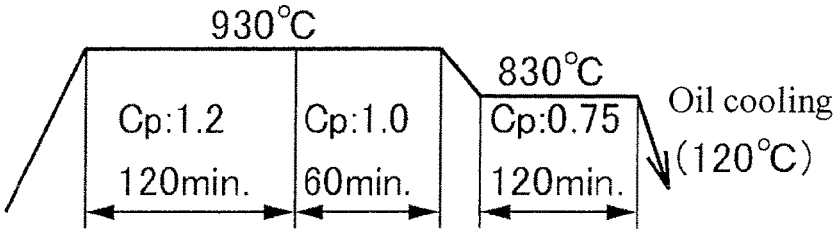

Herein, the method for carburizing and hardening (S5) applied to each specimen includes a treatment corresponding to any of symbols (a), (b) and (c) representing "carburizing conditions" in Table 1, and the treatment is depicted in any of FIGS. 3 (A), 3 (B) and 3 (C). More specifically, the carburizing condition (a) comprises carburizing and dispersing treatments in which each specimen is kept at 930° C. and a carbon potential (hereinafter referred to as "Cp") of 1.05 for 150 minutes, and subsequently at 930° C. and a Cp of 0.55 for 20 minutes, and further kept at 830° C. and a Cp of 0.55 for 30 minutes. Subsequently thereto, the specimen is hardened in a low-temperature oil bath kept at 50° C., or equivalently, given the so-called cold hardening. In (b), each specimen is kept at 930° C. and a Cp of 1.05 for 35 minutes, and other procedures are the same as those in (a). And (c) includes carburizing and dispersing treatments in which each specimen is kept at 930° C. and a Cp of 1.2 for 120 minutes, and subsequently at 930° C. and a Cp of 1.0 for 60 minutes, and further kept at 830° C. and a Cp of 0.75 for 120 minutes. Subsequently thereto, the test specimen is hardened in a usual oil bath kept at 120° C., or equivalently, given the so-called "semi-hot hardening".

In the second place, methods of testing are described. And target values in various tests are illustrated.

Figure 4:
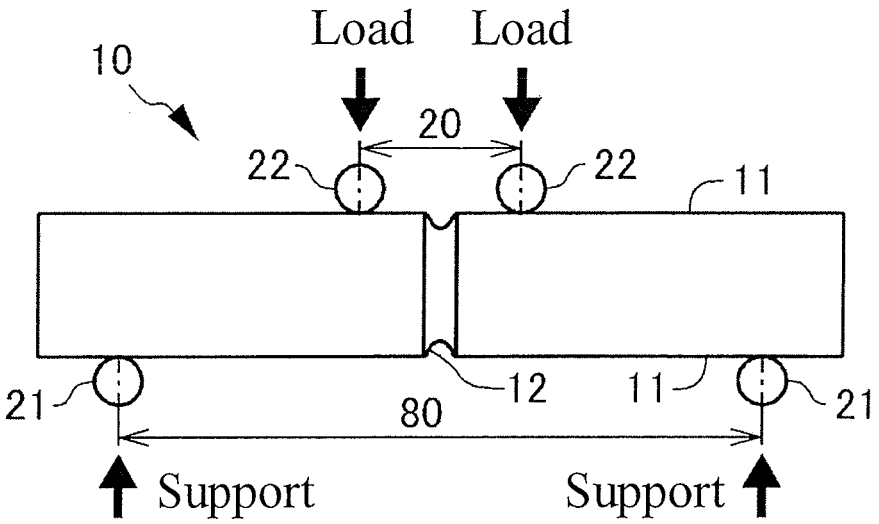
FIGS. 4 (A) and 4 (B) show a specimen's front view (4 (A)) on which load positions in a 4-point bending fatigue test are plotted, and a side view (4 (B)) of the specimen, respectively.
Figure 4:
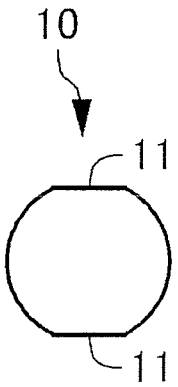

In a bending fatigue test, the 4-point bending fatigue specimen of the foregoing specimens is used as shown in FIGS. 4 (A) and 4 (B). The 4-point bending fatigue specimen 10 is a rod which measures 19 mm in diameter and 100 mm in length, has on both sides parallel planes 11 formed by machining so as to leave a space of 17 mm in the diameter direction, and further has at the center in the length direction a groove 12 formed by machining so as to leave a diameter of 13 mm at the bottom of the groove. One of the parallel planes 11 of the 4-point bending fatigue specimen 10 is made to be tangent to two support members 21 having a spacing of 80 mm, and the plane 11 on the other side is made to be tangent to two load members 22 placed allowing a 20 mm spacing and facing each other across the groove. In such a situation, the bending loads are imposed repeatedly on the specimen, and temporal strength at the time of $3\times10^4$ iterations is determined. The displacement limiter is set to 0.2 mm, the loads are under load control, and the frequency is 1 to 2 Hz. Herein, the target value for temporal strength is 1,550 MPa or higher.

In hardness testing, Vickers hardness tests are made on each hardness specimen. The hardness of an outermost surface layer lying at a depth (the distance from the surface of the specimen in a direction perpendicular to the surface and toward the core of the specimen) of 25 μm below the surface in a cross section of the hardness specimen ($Hv_{d=25\ \mu m}$) is determined. The hardness of a surface layer lying at a depth of 50 μm below the surface in a cross section of the hardness specimen ($Hv_{d=50\ \mu m}$) is determined. The core hardness in the vicinity of the specimen's central part in a cross section of the hardness specimen is determined. Loads in hardness measurements at the depths of 25 μm and 50 μm below the specimen's surface are 200 g and 300 g in weight, respectively, and each measurement is carried out at 5 points and the mean of these 5 measurement values is adopted. Further, a hardness profile in the depth direction is measured, and the 700-Hv depth, namely the depth where hardness is 700 Hv, is determined. Herein, the target value for outermost surface layer hardness ($Hv_{d=25\ \mu m}$) is 650 Hv or greater, the target value for surface layer hardness ($Hv_{d=50\ \mu m}$) is 750 Hv or smaller, preferably 720 Hv or smaller, the target value for the 700-Hv depth is 0.35 mm or smaller, preferably 0.30 mm or smaller, and the target value for ECD (Effective Case Depth) is within the 0.4-mm to 1.1-mm range, preferably within the 0.5-mm to 0.8-mm range. Furthermore, the target value for a difference between surface layer hardness and outermost surface layer hardness ($|Hv_{d=50\ \mu m}-Hv_{d=25\ \mu m}|$) is 50 Hv or smaller.

As to the measurement of a carbon content in the surface layer, the maximum value of a carbon content in the vicinity of the surface layer of each hardness specimen is determined by optical emission spectrometric analysis based on JIS G 1253. Determination of the C content is made using a calibration curve prepared to allow determination of C contents up to 1% for example 0-1% (i.e. 1% or less). Herein, the target value for the C content in the surface layer is within the 0.45%-to-0.75% range, preferably within the 0.45%-to-0.70% range.

Results obtained in the various tests and measurements are shown in Table 2.

TABLE 2

| | Mo/(10Si + Mn + Cr) | C content in surface layer (%) | Outermost surface layer hardness [1] (Hv) | Surface layer hardness [2] (Hv) | ECD (mm) | Core hardness (Hv) | Δ [2] − [1] | 700-Hv depth (mm) | Temporal strength at $3 \times 10^4$ iterations (MPa) |
|---|---|---|---|---|---|---|---|---|---|
| Example 1 | 0.10 | 0.71 | 715 | 734 | 0.82 | 377 | 19 | 0.18 | 1603 |
| Example 2 | 0.15 | 0.70 | 711 | 728 | 0.75 | 339 | 17 | 0.31 | 1636 |
| Example 3 | 0.19 | 0.72 | 717 | 741 | 0.77 | 344 | 24 | 0.32 | 1662 |
| Example 4 | 0.26 | 0.72 | 717 | 729 | 0.80 | 367 | 12 | 0.27 | 1685 |
| Example 5 | 0.15 | 0.70 | 716 | 735 | 0.74 | 326 | 19 | 0.23 | 1813 |
| Example 6 | 0.15 | 0.70 | 716 | 735 | 0.83 | 356 | 19 | 0.34 | 1554 |
| Example 7 | 0.21 | 0.62 | 702 | 718 | 0.55 | 339 | 16 | 0.10 | 2127 |
| Example 8 | 0.20 | 0.65 | 702 | 719 | 0.58 | 384 | 17 | 0.14 | 2045 |
| Example 9 | 0.20 | 0.61 | 701 | 717 | 0.54 | 337 | 17 | 0.09 | 2155 |
| Example 10 | 0.25 | 0.62 | 708 | 723 | 0.55 | 331 | 15 | 0.12 | 2092 |
| Comparative Example 1 | 0.13 | 0.77 | 727 | 736 | 0.77 | 308 | 15 | 0.41 | 1510 |
| Comparative Example 2 | 0.21 | 0.75 | 729 | 752 | 0.82 | 323 | 23 | 0.44 | 1395 |
| Comparative Example 3 | 0.16 | 0.74 | 719 | 738 | 0.83 | 386 | 19 | 0.35 | 1536 |
| Comparative Example 4 | 0.20 | 0.74 | 735 | 751 | 0.81 | 300 | 16 | 0.41 | 1253 |
| Comparative Example 5 | 0.25 | 0.77 | 770 | 781 | 0.83 | 330 | 11 | 0.46 | 1274 |
| Comparative Example 6 | 0.09 | 0.75 | 707 | 731 | 0.89 | 358 | 23 | 0.35 | 1533 |
| Comparative Example 7 | 0.20 | 0.77 | 724 | 743 | 0.93 | 389 | 19 | 0.48 | 1200 |
| Comparative Example 8 | 0.10 | 0.73 | 708 | 731 | 0.84 | 316 | 22 | 0.33 | 1519 |
| Comparative Example 9 | 0.10 | 0.74 | 708 | 731 | 0.83 | 299 | 23 | 0.32 | 1545 |
| Comparative Example 10 | 0.16 | 0.73 | 720 | 738 | 0.82 | 296 | 18 | 0.34 | 1505 |
| Comparative Example 11 | 0.03 | 0.69 | 690 | 722 | 0.82 | 339 | 31 | 0.28 | 1549 |
| Comparative Example 12 | 0.10 | 0.70 | 707 | 730 | 0.86 | 406 | 22 | 0.35 | 1528 |
| Comparative Example 13 | 0.06 | 0.69 | 699 | 725 | 0.85 | 376 | 26 | 0.32 | 1545 |
| Comparative Example 14 | 0.05 | 0.72 | 694 | 721 | 0.73 | 354 | 27 | 0.21 | 1503 |
| Comparative Example 15 | 0.07 | 0.72 | 701 | 733 | 0.83 | 363 | 32 | 0.18 | 1504 |
| Comparative Example 16 | 0.47 | 0.77 | 748 | 758 | 0.77 | 358 | 9 | 0.41 | 1455 |
| Comparative Example 17 | 0.13 | 0.70 | 637 | 719 | 0.42 | 283 | 82 | 0.16 | 1734 |
| Reference Example 1 | 0.47 | 0.87 | 650 | 710 | 0.69 | 304 | 60 | 0.24 | 1662 |

Results of the various tests in Examples 1 to 10 have satisfied the target values specified above. More specifically, alloys formed in Examples 1 to 10 so as to have the compositions shown in Table 1 have undergone carburizing and hardening under individually given carburizing conditions, whereby hardness profiles as specified above have come to attains. Thus, it has become possible to obtain carburized parts having improved medium-cycle fatigue strengths. Additionally, in Examples 7 to 10 where the carburizing condition (b) was adopted, there has been a tendency of the temporal strengths to be superior to those in Examples 1 to 6 where the carburizing condition (a) was adopted. As a reason for such a tendency, it can be thought that the time for the early-stage carburization in the carburizing condition (b) was rendered short in comparison with that in the carburizing condition (a), and this situation has allowed, as shown in Table 2, the C content in the surface layer to be reduced to a lower value and the hardness of a carburized layer in its entirety to be controlled, and has become a factor responsible for superiority in temporal strength.

By the way, the depth of a carburization anomaly layer resulting from carburizing and hardening depends on a parameter $P_a$ given by expression (1), $P_a$=10[Si]+[Mn]+[Cr], wherein [M] represents a content of element M in terms of % by mass. The greater the parameter $P_a$ affecting the depth of a carburization anomaly layer, the more likely a carburization anomaly layer is formed. Further, the medium cycle fatigue strength can be evaluated using a parameter obtained by dividing % by mass of Mo content, [Mo], by the $P_a$ given by the expression (1), namely $P_b$ given by expression (2), $P_b$=[Mo]/(10[Si]+[Mn]+[Cr]). By adjusting this fatigue parameter $P_b$ to fall within a range given by expression (3), $0.10 \leq P_b \leq 0.40$, the temporal strength in a state of fatigue due to $3\times10^4$ iterations can be increased to 1,550 MPa or higher. In Examples 1 to 10, as shown in Table 2, the values of fatigue parameter $P_b$ were in a range of 0.10 to 0.26, which satisfies the expression (3).

Next, test results in Comparative Examples 1 to 17 and Reference Example 1 are illustrated.

Alloys used in Comparative Examples 1, 2, 4 and 5 had roughly the same compositions as those used in Examples 1 to 10, but the temporal strength attained in each of these Comparative Examples has become lower than the target value for temporal strength. In Comparative Example 1, the C content in the surface layer has become a value of 0.77%, which is higher than the target value, and the 700-Hv depth has become a value of 0.41 mm, which is greater than the target value. In each of Comparative Examples 2 and 4, on the other hand, the C content in the surface layer has been within the target value range thereof, but close to the upper limit of the range. And in Comparative Examples 2 and 4, the values of surface layer hardness have become 752 Hv and 751 Hv, respectively, which are higher than the target value for surface layer hardness, and the values of 700-Hv depth have become 0.44 mm and 0.41 mm, respectively, which are greater than the target value for 700-Hv depth. In Comparative Example 5, the C content in the surface layer has become a value of 0.77%, which is higher than the target value, and therefore the surface hardness has become higher than the target value, specifically a value of 781 Hv, and the 700-Hv depth has become a value of 0.46 mm, which is greater than the target value. Thus, it can be thought that the temporal strengths in Comparative Examples 1, 2, 4 and 5 have come to range from 1,253 MPa to 1,510 MPa, or equivalently, they all have become lower than the target value.

Each of Cr contents in Comparative Examples 3, 6 and 7 was 1.40% or 1.41% by mass, and these Cr contents were higher than the Cr contents in Examples 1 to 10. Cr is thought to accelerate oxidation of grain boundaries, thereby causing formation of a carburization anomaly layer, and besides Cr is thought to make the 700-Hv depth greater. The 700-Hv depths in Comparative Examples 3 and 6 have reached the upper target value limit, or 0.35 mm, and it can thus be thought that the temporal strengths in these Comparative Examples have become 1,536 MPa and 1,533 MPa, respectively, which are lower than the target value for temporal strength. In Comparative Example 6, the value of the fatigue parameter $P_b$ was 0.09, which is also lower than the target value for $P_b$. And in Comparative Example 7 also, the C content in the surface layer has become 0.77%, which is higher than the target value, and the 700-Hv depth has become 0.48 mm, which is also greater than the target value. Thus, it can be thought that the temporal strength in this Comparative Example has become 1,200 MPa falling far short of the target value for temporal strength.

In Comparative Examples 8, 9, 11, 14 and 15, the Mo contents were low as compared with those in Examples 1 to 10, and ranged from 0.11 to 0.22% by mass. Mo conduces to improvement in hardening property. In these Comparative Examples, it is therefore thought that the hardening has become insufficient, and the attained temporal strengths have ranged from 1,503 MPa to 1,549 MPa, which are lower than the target value. Additionally, the values of fatigue parameter $P_b$ in Comparative Examples 8 and 9 were the lower limit of the target value and those in Comparative Examples 11, 14 and 15 were 0.03, 0.05 and 0.07, respectively, which are smaller than the target value.

The Mn content in Comparative Example 10 was 0.39% by mass, and it was low in comparison with those in Examples 1 to 10. Mn also conduces to improvement in hardening property. In other words, it is thought that, in Comparative Example 10, hardening has become insufficient, and the attained temporal strength has become a value of 1,505 MPa, which is lower than the target value.

In Comparative Examples 12 and 13, the Si contents were 0.20% and 0.21% by mass, respectively, and high as compared with those in Examples 1 to 10. The value of fatigue parameter $P_b$ in Comparative Example 12, though fell within the target value range, was on the order of the range's lower limit, 0.10, and the value of $P_b$ in Comparative Example 13 was 0.06, which is smaller than the target value. Thus, the temporal strengths have reached 1,528 MPa and 1,545 MPa, respectively, which are lower than the target value. It can be thought that the carburization anomaly layer formed through the grain boundary oxidation accelerated by Si has lowered high cycle fatigue strength in particular and, as a consequence thereof, medium cycle fatigue strength also has been lowered.

In Comparative Example 16, the Cr content was rendered low and the Ni and Mo contents were rendered high in comparison with those in Examples 1 to 10. In Comparative Example 16, the carburizing and hardening treatment indicated in the carburizing and hardening condition (a) was given, and the C content in the surface layer has become a value of 0.77%, which is higher than the target value. Accordingly, it is thought that the surface layer hardness has become higher than the target value, specifically a value of 758 Hv, the 700-Hv depth has become greater than the target value, specifically a value of 0.41 mm, and the temporal strength has become lower than the target value, specifically a value of 1,455 MPa.

An alloy used in Comparative Example 17 had roughly the same composition as those used in Examples 1 to 10, but it was given the carburizing and hardening treatment indicated in the carburizing and hardening condition (c), namely "semi-hot hardening". Therein, the carburizing and diffusing treatment has succeeded in making the C content in the surface layer equivalent to those in Examples 1 to 10, but due to "semi-hot hardening", the outermost surface layer hardness has become lower than the target value, specifically a value of 637 Hv. In addition, the difference between the surface layer hardness and the outermost surface layer hardness has become 82, which is far greater than the target value. In other words, Comparative Example 17 has failed to attain the specified hardness profile. In addition, the core hardness has become 283 Hv, which is significantly low as compared with those in Examples 1 to 10. Therein, the 700-Hv depth has become 0.16 mm, and the temporal strength has become 1,734 MPa, which satisfies the target value for medium cycle fatigue. On the other hand, the difference between the surface layer hardness and the outermost surface layer hardness has become great, and the attained surface fatigue strength is therefore thought to be inferior.

In addition, an alloy adopted in Reference Example 1 had the same composition as that in Comparative Example 16, but it was given the carburizing and hardening treatment indicated in the carburizing and hardening condition (c). Although the C content in the surface layer has become the same value as that in Comparative Example 16, the difference between the surface layer hardness and the outermost surface layer hardness has become a value of 60, which is greater than the target value. In other words, as in the explanation about the distribution of hardness L2 in FIG. 1, it can be thought that Reference Example 1 compensated for degradation in hardening property due to occurrence of a carburization anomaly layer with an intensity increase achieved by performing "cold hardening" in the hardening step after carburizing treatment and thereby allowing prevention of a reduction in hardness of the outermost surface in the carburized layer.

From these test results, we have considered that, as long as steels having the compositions as adopted in Examples 1 to 10 satisfy target values for the fatigue parameter $P_b$, the target value for temporal strength at $3\times10^4$ iterations can be attained by giving the specified carburizing treatment and carburization hardening to the steels. This carburizing treatment and carburization hardening has been controlled so that a C content in the surface layer hardness, outermost surface layer hardness, surface layer hardness and a difference between outermost surface hardness and surface layer hardness in particular can satisfy their respective target values. Further, the toughness value in a more inner portion can be enhanced by adjusting the 700-Hv depth to satisfy the target value, and thereby carburized parts having excellent medium-cycle fatigue strength in particular can be obtained. Additionally, in order to satisfy these target values, it has been effective to perform "cold hardening" in carburizing and hardening treatment, namely hardening by immersion into a low-temperature oil bath kept at no higher than 80° C. Further, by carburizing treatment, each of the foregoing steels has attained similar results regardless of whether the carburizing treatment was carburizing treatment in a gas likely to oxidize the steel surface or carburizing treatment in a vacuum.

On the basis of the results mentioned above and within the range of causing no impairments in properties as carburized parts obtained from the steels having the compositions specified in Examples 1 to 10, ranges of compositional proportions of various elements constituting such a steel material are determined in accordance with the following guidelines.

C is an important element added for the purpose of ensuring mechanical strength required of carburized parts. In the case where a C content is too low, it is impossible to ensure the mechanical strength, notably at the core of a carburized part. On the other hand, In the case where a C content is too high, it brings about not only degradation in toughness but also reduction in low cycle fatigue strength. Therefore the range of the C content is, in terms of % by mass, 0.15% to 0.25%, preferably 0.18% to 0.22%.

Si can be added as a deoxidizer at melting. In the case where a Si content is too high, it brings about promotion of grain boundary oxidation at the time of carburization, thereby accelerating the formation of a carburization anomaly layer. As a result, it is impossible to ensure outermost surface layer hardness required of carburized parts. Therefore the range of the Si content is, in terms of % by mass, 0.15% or less, preferably 0.10% or less.

Mn is added as a deoxidizer at melting and for the purpose of ensuring the ability of steel to be hardened. In the case where an Mn content is too low, it brings about insufficient hardening, and it is impossible to ensure toughness required of carburized parts. On the other hand, in the case where an Mn content is too high, it brings about promotion of grain boundary oxidation at the time of carburization, thereby accelerating the formation of a carburization anomaly layer. As a result, it is impossible to ensure outermost surface layer hardness required of carburized parts. Therefore the range of the Mn content is, in terms of % by mass, 0.4% to 1.1%, preferably 0.55% to 0.75%.

Cr is added for the purpose of ensuring the ability of steel to be hardened and necessary for attainment of mechanical strength required of carburized parts. However, in the case where a Cr content is too high, it not only brings about promotion of grain boundary oxidation at the time of carburization to result in acceleration of carburization anomaly layer formation, but also enhances the ability of steel to be hardened, and thereby the 700-Hv depth also becomes greater, and medium cycle fatigue strength required of carburized parts is impaired. Therefore the range of the Cr content is, in terms of % by mass, 0.8% to 1.4%, preferably 0.8% to 1.2%.

Mo brings about enhancement of the ability of steel to be hardened without the grain boundary oxidation being promoted, and thereby improving fracture toughness. In the case where a Mo content is too low, it brings about failure to control the growth of unstable cracks, and makes it impossible to ensure medium cycle fatigue strength required of carburized parts. On the other hand, in the case where an Mo content is too high, it allows hardening even at a deeper portion, and brings about an increase in 700-Hv depth and impairment of medium cycle fatigue strength required of carburized parts. Therefore the range of the Mo content is, in terms of % by mass, 0.25% to 0.55%, preferably 0.3% to 0.4%.

P oxidizes grain boundaries. In the case where a P content is too high, it causes reduction in mechanical strength and brings about lowering of low-cycle to medium-cycle fatigue strengths which are required of carburized parts. Therefore, the range of the P content is, in terms of % by mass, 0.015% or less.

S forms sulfides and increases the growth speed of cracks. In the case where an S content is too high, it brings about lowering of low-cycle to medium-cycle fatigue strengths which are required of carburized parts. Therefore the range of the S content is, in terms of % by mass, 0.035% or less.

Additionally, Cu and Ni are elements incorporated inevitably in steel whose raw material is scrap iron, and positive addition thereof is not carried out.

While the mode for carrying out the present invention has been described in detail above, the present invention is not limited to these embodiments, and various changes and modifications can be made therein without departing from the purport of the present invention.

Incidentally, this application is based on Japanese patent application No. 2013-080732 filed Apr. 8, 2013, and the entire contents thereof being hereby incorporated by reference.

What is claimed is:

1. A carburized part comprising a carburized layer formed by performing a carburizing treatment to an outer surface of steel, the steel consisting of, in terms of % by mass:

0.15% to 0.25% of C,
0.15% or less of Si,
0.4% to 1.1% of Mn,
0.8% to 1.4% of Cr,
0.25% to 0.55% of Mo,
0.015% or less of P,
0.035% or less of S, and
a remainder of Fe and unavoidable impurities, and the steel satisfying the following relation:

$$0.10 \leq [Mo]/(10[Si]+[Mn]+[Cr]) \leq 0.40$$

wherein [M] represents a content of element M in terms of % by mass, wherein, in the carburized part, a maximum C content of the carburized layer in terms of % by mass is within a range of 0.61% to 0.75%, and wherein a hardness $HV_{d=25\ \mu m}$ at a depth of 25 μm below the outer surface of the steel is 650 Hv or higher, a hardness $HV_{d=50\ \mu m}$ at a depth of 50 μm below the outer surface of the steel is 750 Hv or lower, a difference between the hardness $HV_{d=25\ \mu m}$ and the hardness $Hv_{d=50\ \mu m}$ is 50 Hv or smaller, and the hardness $HV_{d=25\ \mu m}$ is less than the hardness $Hv_{d=50\ \mu m}$.

2. The carburized part according to claim 1, wherein any depth where a hardness is 700 Hv is 0.35 mm or less from the outer surface.

3. A method for manufacturing a carburized part, at least comprising:

performing a predetermined machining to an outer surface of a steel consisting of, in terms of % by mass:

0.15% to 0.25% of C,
0.15% or less of Si,
0.4% to 1.1% of Mn,
0.8% to 1.4% of Cr,
0.25% to 0.55% of Mo,
0.015% or less of P, and
0.035% or less of S,
a remainder of Fe and unavoidable impurities, and the steel satisfying the following relation:

$$0.10 \leq [Mo]/(10[Si]+[Mn]+[Cr]) \leq 0.40$$

wherein [M] represents a content of element M in terms of % by mass; and performing a carburizing treatment wherein the machined steel is heated at a predetermined temperature and subjected to a carburizing and diffusing treatment in a carburizing atmosphere having a predetermined carbon potential, and then hardened in a low-temperature oil bath kept at a temperature 80° C. or lower at the highest, thereby providing a carburized layer, wherein, in the carburizing treatment, a maximum C content of the carburized layer in terms of % by mass is controlled to be within a range of 0.61% to 0.75%, and wherein a hardness $HV_{d=25\ \mu m}$ at a depth of 25 μm below the outer surface of the steel is controlled to be 650 Hv or higher, a hardness $HV_{d=50\ \mu m}$ at a depth of 50 μm below the outer surface of the steel is controlled to be 750 Hv or lower, a difference between the hardness $HV_{d=25\ \mu m}$ and the hardness $Hv_{d=50\ \mu m}$ is controlled to be 50 Hv or smaller, and the hardness $HV_{d=25\ \mu m}$ is less than the hardness $Hv_{d=50\ \mu m}$.

4. The method for manufacturing a carburized part according to claim 3, wherein the carburizing treatment provides a region having a hardness of 700 Hv or higher at a depth within 350 μm or less below the outer surface of the steel.

* * * * *